US009037035B2

(12) United States Patent
Nakai et al.

(10) Patent No.: US 9,037,035 B2
(45) Date of Patent: May 19, 2015

(54) IMAGE FORMING APPARATUS INCLUDING TONER CHARGING MEMBER FOR CHARGING AND MOVING RESIDUAL TONER

(75) Inventors: Tomoaki Nakai, Numazu (JP); Kimitaka Ichinose, Mishima (JP); Hiroyuki Kadowaki, Mishima (JP); Takao Kume, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 108 days.

(21) Appl. No.: 13/209,695

(22) Filed: Aug. 15, 2011

(65) Prior Publication Data

US 2012/0051785 A1 Mar. 1, 2012

(30) Foreign Application Priority Data

Aug. 31, 2010 (JP) ..... 2010-194062

(51) Int. Cl.

| | |
|---|---|
| ***G03G 21/00*** | (2006.01) |
| ***G03G 15/01*** | (2006.01) |
| ***G03G 15/16*** | (2006.01) |

(52) U.S. Cl.

CPC ..... *G03G 15/161* (2013.01); *G03G 15/0131* (2013.01); *G03G 21/0011* (2013.01); *G03G 2215/0132* (2013.01); *G03G 2215/1661* (2013.01)

(58) Field of Classification Search

USPC ..... 399/101, 129, 299, 302, 308, 66

See application file for complete search history.

(56) References Cited

U.S. PATENT DOCUMENTS

| | | | | |
|---|---|---|---|---|
| 6,070,047 | A | 5/2000 | Ichinose et al. | |
| 6,393,250 | B1 | 5/2002 | Tsukida et al. | |
| 6,473,574 | B1 * | 10/2002 | Usui et al. | 399/66 |
| 7,978,998 | B2 * | 7/2011 | Nakagawa et al. | 399/101 |
| 8,027,612 | B2 * | 9/2011 | Soda | 399/101 |

FOREIGN PATENT DOCUMENTS

| | | | |
|---|---|---|---|
| JP | 9-50167 | A | 2/1997 |
| JP | 10-333454 | A | 12/1998 |
| JP | 2000-321881 | A | 11/2000 |

(Continued)

OTHER PUBLICATIONS

Office Action dated Jul. 1, 2014, in Japanese Patent Application No. 2010-194062.

*Primary Examiner* — Robert Beatty

(74) *Attorney, Agent, or Firm* — Fitzpatrick, Cella, Harper & Scinto

(57) ABSTRACT

The present invention ensures stable cleaning performance with respect to remaining toner on an intermediate transfer belt without increasing the size and cost of an image forming apparatus. The present invention provides an image forming apparatus in which residual toner charged by a toner charging member is transferred from the intermediate transfer belt to a photosensitive drum, the toner charging member is placed with respect to the intermediate transfer belt in a rotation direction of the intermediate transfer belt such that a first distance of the intermediate transfer belt from a position where a secondary transfer member contacts the intermediate transfer belt to a position where the toner charging member contacts the intermediate transfer belt is longer than a second distance from the position where the toner charging member contacts the intermediate transfer belt to a position where an image bearing member placed most upstream contacts the intermediate transfer belt.

6 Claims, 5 Drawing Sheets

(56) References Cited

FOREIGN PATENT DOCUMENTS

| | | | | |
|---|---|---|---|---|
| JP | 2001117424 | A | * | 4/2001 |
| JP | 2002-148895 | A | | 5/2002 |
| JP | 2002-162837 | A | | 6/2002 |
| JP | 2005-17424 | A | | 1/2005 |
| JP | 2005-227308 | A | | 8/2005 |
| JP | 2008-089840 | A | | 4/2008 |
| JP | 2009139442 | A | * | 6/2009 |
| JP | 2009300764 | A | * | 12/2009 |
| JP | 2010-060945 | A | | 3/2010 |
| JP | 2010134320 | A | * | 6/2010 |

* cited by examiner

IMAGE FORMING APPARATUS INCLUDING TONER CHARGING MEMBER FOR CHARGING AND MOVING RESIDUAL TONER

BACKGROUND OF THE INVENTION

1. Field of the Invention

The present invention relates to an image forming apparatus such as a copier or printer provided with a function to form images on a recording material such as sheets.

2. Description of the Related Art

From the viewpoint of media flexibility, the following method is available to an electrophotographic color image forming apparatus. The method involves, after forming toner images on a photosensitive body, transferring (hereinafter, primary transfer) the toner images to an intermediate transfer member (intermediate transfer belt), forming the toner images of multiple colors one on top of another on the intermediate transfer member, and then transferring (hereinafter, secondary transfer) the toner images to a recording material. This method requires cleaning of the intermediate transfer member because part of the toner is left on the intermediate transfer member without being transferred to the recording material after the secondary transfer.

Available cleaning methods include a method which removes toner left on the intermediate transfer member using a blade, fur brush, or the like, and collects and contains the toner in a residual toner container. However, this method requires a transport unit for transporting the toner to the residual toner container. Also, the method requires a user to replace the residual toner container, and thus is not desirable from the viewpoint of usability.

To solve this problem, the following cleaning methods have been proposed and put to practical use.

Japanese Patent Application Laid-Open No. H09-50167 discloses a charging member adapted to charge remaining toner on the intermediate transfer member to a polarity opposite to the original charge polarity of the toner. In a transfer portion of a photosensitive drum disposed downstream of the charging member, toner images are transferred from the side of a photosensitive body to the intermediate transfer member by normal image formation and the oppositely charged toner remaining on the intermediate transfer member after secondary transfer are electrostatically attracted and moved to the photosensitive body to replace the toner images. The toner remaining after the secondary transfer and transferred to the photosensitive body is collected by a cleaning portion on the photosensitive body. Japanese Patent Application Laid-Open No. 2005-227308 discloses a configuration for downsizing an apparatus by using a common counter member for a charging member and secondary transfer member.

There is the following problem in a configuration in which multiple image bearing members are placed below the intermediate transfer belt in order to reduce the interval between the time when electrostatic latent images start to be formed by exposure of the multiple image bearing members with an exposure unit and the time when toner images are secondarily transferred to a transfer material. Among configurations in which multiple image bearing members are placed below the intermediate transfer belt, a configuration in which the exposure unit is placed below the multiple image bearing members is known generally.

Suppose a counter member is shared by the charging member adapted to charge residual toner and the secondary transfer member as described in Japanese Patent Application Laid-Open No. 2005-227308. Then, depending on the situation, the remaining toner charged by the charging member subsequently moves a long distance by being carried by the intermediate transfer belt until coming into contact with the image bearing members. If the charge of the residual toner on the intermediate transfer belt decays during the movement, the residual toner will scatter from a bend of the intermediate transfer belt or will have difficulty in moving to the image bearing members in a primary transfer portion.

SUMMARY OF THE INVENTION

The present invention has been made in view of the above circumstances and has an object to ensure, in an image forming apparatus in which multiple image bearing members are placed below an intermediate transfer belt, that residual toner charged by a charging member can move from the intermediate transfer belt to the image bearing members without scattering.

The present invention provides an image forming apparatus including: a plurality of image bearing members adapted to carry toner images; an endless and rotatable intermediate transfer belt placed above the plurality of image bearing members; a plurality of primary transfer members placed on an inner circumferential surface of the intermediate transfer belt, opposing respective image bearing members of the plurality of image bearing members, and primary transferring the toner images from the opposing image bearing members to the intermediate transfer belt; a secondary transfer member secondary transferring the toner images from the intermediate transfer belt to a transfer material; and a toner charging member charging residual toner remaining on the intermediate transfer belt without being transferred to the transfer material, wherein the residual toner charged by the toner charging member is moved from the intermediate transfer belt to the image bearing members, the toner charging member is placed with respect to the intermediate transfer belt in a rotation direction of the intermediate transfer belt such that a first distance of the intermediate transfer belt from a position where the secondary transfer member contacts the intermediate transfer belt to a position where the toner charging member contacts the intermediate transfer belt is longer than a second distance of the intermediate transfer belt from the position where the toner charging member contacts the intermediate transfer belt to a position where the image bearing member placed most upstream contacts the intermediate transfer belt.

Further features of the present invention will become apparent from the following description of exemplary embodiments with reference to the attached drawings.

DESCRIPTION OF THE EMBODIMENTS

Embodiments of the present invention will be described in detail below by way of example with reference to the drawings. However, the sizes, materials, shapes, and relative locations of the components described in the following embodiments are to be changed as required depending on the configuration and conditions of the apparatus to which the present invention is applied, and the scope of the present invention is not limited to the embodiments described below.

First Embodiment

<Overall Configuration of Image Forming Apparatus>

Figure 1:
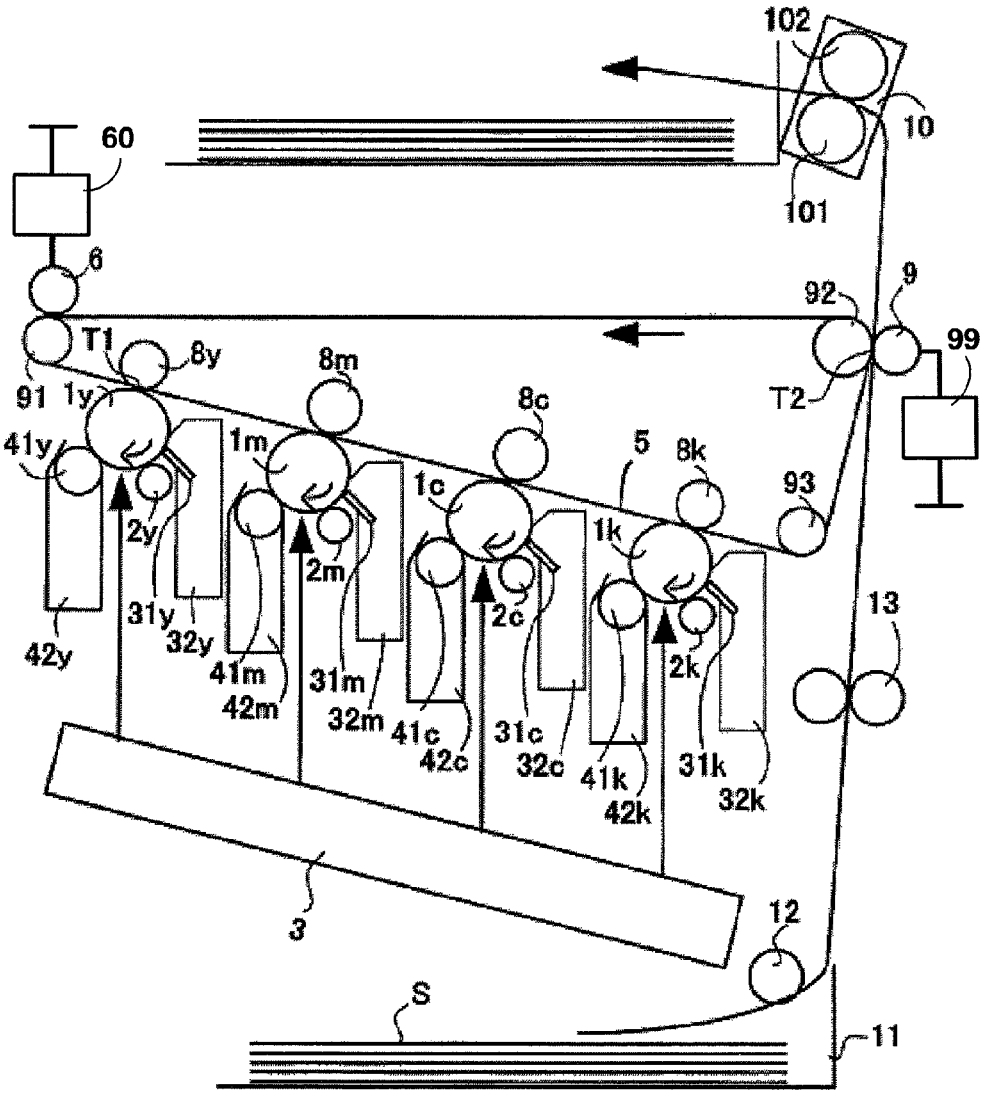
FIG. 1 is a sectional view showing an overall configuration of an image forming apparatus according to a first embodiment.

An overall configuration of a color image forming apparatus will be described with reference to FIG. 1. FIG. 1 is a sectional view showing an overall configuration of an intermediate-transfer, four-color, in-line full-color printer which is a form of an electrophotographic image forming apparatus according to a first embodiment of the present invention.

The image forming apparatus shown in FIG. 1 has photosensitive drums 1 (1*y*, 1*m*, 1*c* and 1*k*) as four image bearing members arranged side by side in a substantially horizontal direction. The photosensitive drums 1 are rotationally driven clockwise by a drive unit (not shown). Cleaning blades 31, residual toner containers 32, electrostatic charging devices 2, a scanner 3, developing rollers 41, toner supply containers 42, an endless and rotatable intermediate transfer belt 5, and a secondary transfer roller 9 are disposed in order along a rotation direction around the photosensitive drums 1.

The cleaning blades 31 (31*y*, 31*m*, 31*c* and 31*k*) remove toner from the photosensitive drums 1 (image bearing members). The residual toner containers 32 (32*y*, 32*m*, 32*c* and 32*k*) store remaining toner collected by the cleaning blades 31. The electrostatic charging devices 2 (2*y*, 2*m*, 2*c* and 2*k*) charge surfaces of the photosensitive drums 1 uniformly. The scanner 3 forms electrostatic latent images by irradiating the photosensitive drums 1 with a laser beam based on image information. The developing rollers 41 (41*y*, 41*m*, 41*c* and 41*k*) is a developing unit adapted to develop the electrostatic latent images into toner images (developer images) by attaching toner to the latent images. The toner supply containers 42 (42*y*, 42*m*, 42*c* and 42*k*) supply toner to the developing rollers 41.

Using primary transfer rollers 8 (8*y*, 8*m*, 8*c* and 8*k*) serving as a primary transfer unit, the intermediate transfer belt 5 temporarily carries the toner images on the photosensitive drums 1 and rotationally transports the toner images counterclockwise. The secondary transfer roller 9 is a secondary transfer unit which transfers the toner images from the intermediate transfer belt 5 to the recording material.

The photosensitive drums 1, cleaning blades 31, residual toner containers 32, electrostatic charging devices 2, developing rollers 41 and toner supply containers 42 are integrated into a cartridge, forming a process cartridge which can be detachably attached to a body of the image forming apparatus (hereinafter referred to as an apparatus body).

Next, configurations of various parts will be described in sequence.

Each photosensitive drum 1 is made, for example, of a 30-mm-diameter aluminum cylinder whose outer circumferential surface is coated with an organic photoconductor layer (OPC photosensitive body). The photosensitive drum 1 is rotatably supported by a support member at opposite ends and is rotationally driven clockwise in FIG. 1 as a driving force is transmitted to one end from a drive motor (not shown).

Each cleaning blade 31 is made of an elastic rubber plate configured to abut the corresponding photosensitive drum 1. The cleaning blades 31 remove unnecessary toner such as non-transferred remaining toner from the respective photosensitive drums 1 before steps of forming latent images and toner images on the photosensitive drums 1.

The remaining toner removed by the cleaning blades 31 are collected in the residual toner containers 32 and discarded when the process cartridge is changed.

Each electrostatic charging device 2 includes a roller-shaped, electrically conductive roller. The rollers are abutted against the surfaces of the respective photosensitive drums 1 and a predetermined negative charge bias equal to or higher than a firing voltage is applied to the rollers from a power supply (not shown). Consequently, the surfaces of the photosensitive drums 1 are negatively charged uniformly.

The scanner 3 includes a laser optical unit. Laser light L is emitted according to an image signal under the control of a drive circuit (not shown). The scanner 3 selectively exposes charged surfaces of the photosensitive drums 1 to form electrostatic latent images.

A developing apparatus includes the toner supply containers 42 and developing rollers 41, where the toner supply containers 42 contain yellow, magenta, cyan and black toners, respectively, starting from the upstream side along the rotation direction of the intermediate transfer belt 5 (the left side in FIG. 1). The toners are transported from the toner supply containers 42 to the developing rollers 41 and the toners attached to the developing rollers 41 are charged to a uniform polarity (negative polarity, in this case) by rubbing. In this state, a negative developing bias smaller in absolute value than surface potential of the photosensitive drums 1 is applied to the developing rollers 41. This allows the toners to be attached only to the electrostatic latent images, causing the latent images to visualize as toner images.

Each primary transfer roller 8 is a roller-shaped, electrically conductive roller made of a foamed elastic roller disposed around a 6-mm outside diameter shaft made of metal such as SUS (stainless steel) so as to have an outside diameter of 12 mm. The foamed elastic roller has a resistance of $10^6$ to $10^9\Omega$ and the primary transfer rollers 8 are pressed toward the respective photosensitive drums 1 via the intermediate transfer belt 5. A positive primary transfer bias is applied to the primary transfer rollers 8 from a power supply (not shown), causing the yellow, magenta, cyan and black toner images to be transferred in this order from the photosensitive drums 1 to the intermediate transfer belt.

The intermediate transfer belt 5 is made of an endless film member with a thickness of 50 to 150 μm and a volume resistivity of $1\times10^7$ to $1\times10^{14}$ Ωcm. The volume resistivity is measured by applying 50 to 100 V at a temperature of 25° C. and relative humidity of 50% using a measuring probe compliant with JIS K6911 and R2340 High Resistance Meter made by Advantest Corp.

The intermediate transfer belt 5 is stretched by a secondary transfer counter roller 92 which combines with a driving roller adapted to rotate the intermediate transfer belt 5 and driven rollers 91 and 93 adapted to exert appropriate tension. The intermediate transfer belt 5 is placed upstream of the multiple photosensitive drums.

The secondary transfer roller 9 have a configuration and physical properties similar to those of the primary transfer rollers 8. The secondary transfer roller 9 is pressed by the intermediate transfer belt 5 via the recording material S. When a positive secondary transfer bias is applied by a high-voltage power supply 99 for secondary transfer, the toner images are transferred from the intermediate transfer belt 5 to the recording material S. A secondary transfer portion T2 is formed by the secondary transfer roller 9 and the secondary transfer counter roller 92 with the intermediate transfer belt 5 being disposed therebetween. A position of the secondary transfer portion T2 on the intermediate transfer belt 5 corresponds to a second position. The toner image on the photosensitive drum 1*y* is primarily transferred to the intermediate transfer belt 5 through a primary transfer portion T1 formed by the photosensitive drum 1*y* and primary transfer roller 8*y* with the intermediate transfer belt 5 being disposed therebetween. A position of the primary transfer portion T1 on the intermediate transfer belt 5 corresponds to a first position. The second position is located downstream of the first position along the rotation direction of the intermediate transfer belt 5. Hereinafter, the upstream side along the rotation direction of the intermediate transfer belt 5 will simply be referred to as "upstream" (the upstream side) and the downstream side along the rotation direction of the intermediate transfer belt 5 will simply be referred to as "downstream" (the downstream side).

An image forming operation of the image forming apparatus according to the present embodiment is performed as follows.

First, the recording material S contained in a cassette 11 mounted in a lower part of the apparatus body is separated and fed sheet after sheet by a feed roller 12 and transported to the secondary transfer portion T2 by a transport roller pair 13. Then, the yellow, magenta, cyan and black toner images formed on the intermediate transfer belt 5 by primary transfer are secondarily transferred to the recording material S in the secondary transfer portion T2, thereby forming a color image. Then, the recording material S passes through a fixing device 10 including a roller pair formed by a heating roller 101 and pressure roller 102, and thus the unfixed toner images are thermally fixed on the recording material S. Subsequently, the recording material S is discharged to a discharge portion in an upper part of the apparatus body.

With a configuration such as shown in FIG. 1, the distance from the primary transfer portion to the secondary transfer portion along the rotation direction of the intermediate transfer belt can be reduced, the primary transfer portion being formed between the photosensitive drum 1*y* and primary transfer roller 8*y*. Thus the time interval from when the electrostatic latent image is formed on the photosensitive drum 1*y* to when the secondary transfer is started can be reduced.

<Intermediate Transfer Cleaning>

The remaining toner left on the intermediate transfer belt 5 during secondary transfer is charged to a polarity opposite to the original (normal) charge polarity by a cleaning roller 6 serving as a toner charging member, and then moved to the photosensitive drum 1*y*, and thereby cleaned away by the cleaning blade 31*y*. The cleaning blade 31*y* corresponds to a cleaning portion. The original charge polarity is the charge polarity of the toner carried by the photosensitive drums during image formation. According to the present embodiment, the cleaning roller 6 is disposed at a position (third position) downstream of the secondary transfer portion T2 (second position), but upstream of the primary transfer portion T1 (first position). The cleaning roller 6 forms a nip portion (third position) in conjunction with the driven roller 91 via the intermediate transfer belt 5.

The cleaning roller 6 is a solid rubber roller whose resistance has been adjusted to $1\times10^5$ to $1\times10^9\Omega$. A voltage of 0.3 to +1.0 kV is applied to the cleaning roller 6 from a high-voltage power supply 60.

According to the present embodiment, the toner is charged negatively during image formation and when a positive bias is applied to the primary transfer rollers 8 and secondary transfer roller 9, the toner is transferred electrostatically. Thus, the toner left on the intermediate transfer belt 5 without being transferred to the recording material by the secondary transfer mostly remains negatively charged although some part of the toner is charged positively due to discharge into the recording material.

According to the present embodiment, the remaining toner on the intermediate transfer belt 5 is charged in an appropriate quantity of positive charge by the cleaning roller 6. Subsequently, the remaining toner on the intermediate transfer belt 5 is moved to the photosensitive drum 1*y* in the primary transfer portion T1 of the photosensitive drum 1*y* located downstream of the cleaning roller 6.

This is because a positive bias is applied to the primary transfer roller 8*y* and the photosensitive drum 1*y* is charged negatively, causing an electrostatic attractive force to act between the remaining toner and photosensitive drum 1*y*. The electrostatic attractive force acting between the remaining toner and photosensitive drum 1*y* causes the remaining toner to be moved from the intermediate transfer belt 5 to the photosensitive drum 1*y*, in the primary transfer portion T1 of the photosensitive drum 1*y*. On the other hand, since the toner used for image formation is charged negatively, normal transfer can be carried out simultaneously with the movement of the remaining toner.

Subsequently, the remaining toner moved to the photosensitive drum 1*y* is collected by the cleaning blade 31*y* disposed on the photosensitive drum 1*y*.

According to the present embodiment, a distance (first distance) from the secondary transfer portion T2 to the cleaning roller 6 (nip portion) disposed downstream of the secondary transfer portion T2 is made longer than a distance (second distance) from the cleaning roller 6 to the primary transfer portion T1 of the photosensitive drum 1*y* disposed downstream of the cleaning roller 6. Therefore, the charge quantity of remaining toner during secondary transfer decays greatly before the remaining toner reaches the cleaning roller 6. On the cleaning roller 6, with the charge quantity of remaining toner being small, the remaining toner can be charged in an appropriate quantity to the polarity opposite to the original charge, reducing the bias applied to the cleaning roller 6. Also, the charge quantity of remaining toner after charging can be made uniform. When the remaining toner with a small charge quantity reaches a bend, since the belt has low holding power on the residual toner, the toner could scatter from the intermediate transfer belt. According to the present embodiment, as shown in FIG. 1, the cleaning roller 6 is placed above the intermediate transfer belt bent by the driven roller 91. This allows the residual toner to be charged before reaching the bend of the intermediate transfer belt, and thereby reduces scattering of the residual toner.

The first distance is sufficiently longer than a distance (third distance) from the transfer portion formed by the photosensitive drum 1*y* and primary transfer roller 8*y* to the transfer portion formed by the photosensitive drum 1*k* and primary transfer roller 8*k*. This allows the charge quantity of remaining toner after charging to decay sufficiently.

Furthermore, the remaining toner charged to the polarity opposite to the original polarity by the cleaning roller 6 reaches the primary transfer portion T1 with reduced decay. Thus, considering decay in the charge quantity of remaining toner, the bias applied to the cleaning roller 6 can be reduced compared to when there is a large distance from the cleaning roller 6 to the primary transfer portion T1 of the photosensitive drum 1*y* disposed downstream of the cleaning roller 6.

In particular, in an atmosphere environment of low temperature and low humidity, the remaining toner has a large charge quantity, and thus it might become necessary to apply a larger voltage to the cleaning roller 6 than in other atmosphere environments. However, the present embodiment allows the voltage applied to the cleaning roller 6 to be kept down to +1.0 kV.

Consequently, the present embodiment can reduce costs for a high voltage circuit as well as space required to support a high withstand voltage.

Comparative Example

Figure 4:
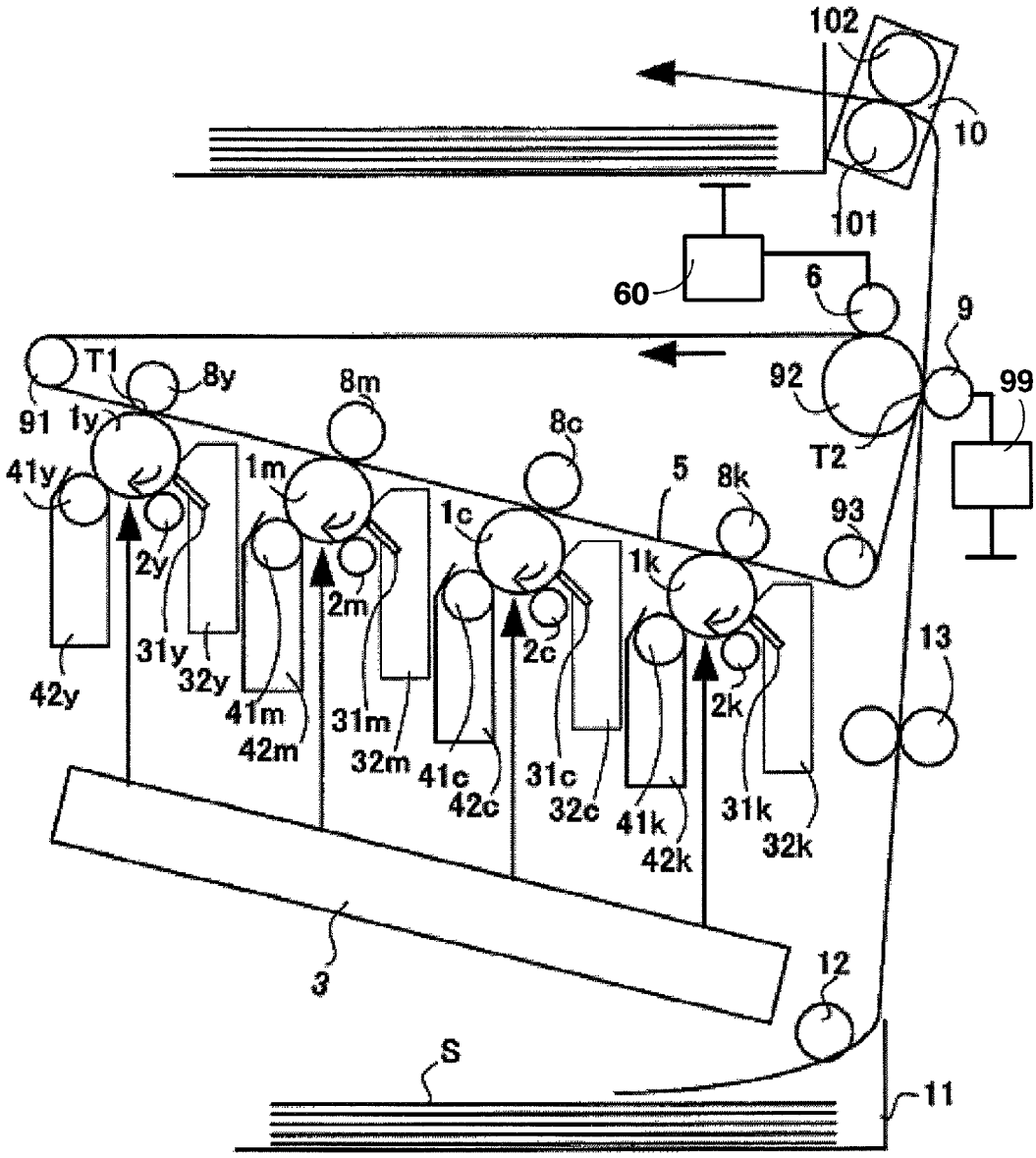
FIG. 4 is a sectional view showing an overall configuration of an image forming apparatus according to a comparative example.

FIG. 4 is a longitudinal sectional view showing an overall configuration of an image forming apparatus according to a comparative example. The comparative example differs from the present embodiment in that the cleaning roller 6 is disposed downstream of the secondary transfer roller 9, facing the secondary transfer counter roller 92. Furthermore, the comparative example differs in the size of the secondary transfer counter roller 92.

Figure 5:
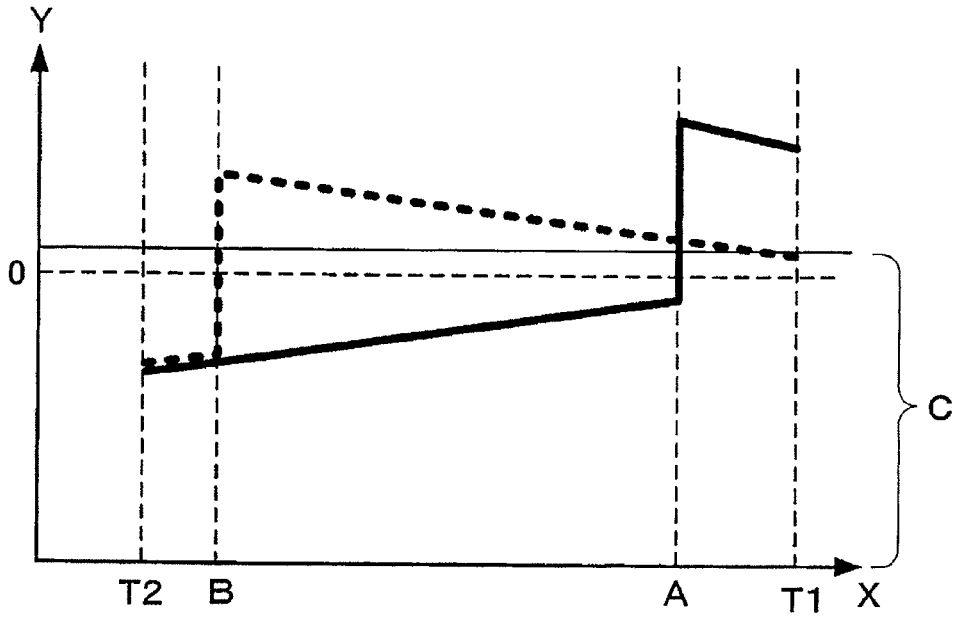
FIG. 5 shows changes in quantity of charge per unit mass of remaining toner according to the first embodiment and comparative example.

FIG. 5 is conceptual diagram showing quantity of charge per unit mass of remaining toner with travel downstream along the rotation direction of the intermediate transfer belt 5 in the present embodiment and comparative example, where a solid line represents the present embodiment and a dotted line represents the comparative example. In FIG. 5, the abscissa X represents a region of the intermediate transfer belt 5 including a region from the secondary transfer portion T2 to the primary transfer portion T1 extending downstream along the rotation direction of the intermediate transfer belt 5. The ordinate Y represents the quantity of charge per unit mass of remaining toner. The area above 0 corresponds to the positive polarity while the area below 0 corresponds to the negative polarity. In FIG. 5, A denotes a charging portion (third position) of the cleaning roller 6 according to the present embodiment, B denotes a charging portion of a cleaning roller 6 according to the comparative example, and C denotes a region of toner charge quantity in which cleaning defects occur. It is assumed that the same voltage is applied to the cleaning rollers 6 and that the capacity to charge the remaining toner is the same between the present embodiment and comparative example.

According to the present embodiment, since the moving distance of the remaining toner from the secondary transfer portion T2 to the cleaning roller 6 is long, the remaining toner can be charged to the polarity opposite to the original polarity using the cleaning roller 6 after the charge of the remaining toner decays. Due to the short moving distance from the cleaning roller 6 to the primary transfer portion T1 where the remaining toner is moved, the decay in the charge quantity of the remaining toner can be reduced. Consequently, the bias applied to the cleaning roller 6 can be reduced. This in turn reduces scattering of the residual toner, and thereby reduces costs for a high voltage circuit as well as space required to support a high withstand voltage.

On the other hand, in the comparative example, there is a short distance from the secondary transfer portion T2 to the cleaning roller 6. Thus the charge quantity of the remaining toner, which is charged to the polarity opposite to the original polarity by the cleaning roller 6, is small. Since the distance from the cleaning roller 6 to the primary transfer portion T1 where the remaining toner is moved is longer than in the present embodiment, the charge quantity of the remaining toner goes on decaying. Consequently, the charge quantity of the remaining toner immediately before the movement is smaller than an appropriate quantity of charge, which could result in cleaning defects. To prevent the cleaning defects, it is conceivable to increase the bias applied to the cleaning roller 6 and thereby increase the capacity to charge the remaining toner. However, in such a case, to ensure cleaning performance, in an atmosphere environment of low temperature and low humidity, a voltage of +2.0 kV needs to be applied to the cleaning roller 6 in the comparative example. This increases costs for a high voltage circuit as well as space required to support a high withstand voltage. Also, the charge quantity of remaining toner at point A is small, which could cause the toner to scatter.

In the comparative example, the cleaning roller 6 and secondary transfer roller 9 need to be placed on the side opposite to the secondary transfer counter roller 92. This makes it necessary to increase the diameter of the secondary transfer counter roller 92, causing disadvantages in terms of cost and space.

Furthermore, in the comparative example, the cleaning roller 6 is placed close to the fixing device 10 which is a heat source. Consequently, the cleaning roller 6 is degraded by heat, which is a disadvantage in terms of durability. Temperature rises in the image forming apparatus cause resistance variations, causing in turn variations in the capacity to charge the remaining toner, which could result in degradation of cleaning performance.

As described above, according to the present embodiment, the distance from the secondary transfer portion T2 to the cleaning roller 6 is longer than the distance from the cleaning roller 6 to the primary transfer portion T1 where the remaining toner is moved. Thus, the remaining toner can be charged to the polarity opposite to the original polarity when the charge of the remaining toner decays after the secondary transfer. This reduces charge decay of the remaining toner during the period from when the remaining toner is charged to when the remaining toner is moved to the photosensitive drum.

Consequently, the bias applied to the cleaning roller 6 can be reduced, ensuring more stable cleaning performance without increasing the size and cost of the image forming apparatus and regardless of changes in the atmosphere environment. Although in the present embodiment, the remaining toner is cleaned away by the cleaning blade 31*y* of the most upstream photosensitive drum 1*y* among the photosensitive drums placed along the rotation direction of the intermediate transfer belt 5, this is not restrictive. A mode for cleaning away the toner remaining on the intermediate transfer belt 5 after secondary transfer may be set up and one of the multiple photosensitive drums and the primary transfer roller facing this photosensitive drum may be caused to operate as the primary transfer portion T1 to move the remaining toner to the drum. In this case, the relationship between the distance from the secondary transfer portion T2 to the cleaning roller 6 and the distance from the cleaning roller 6 to the primary transfer portion T1 is the same as the relationship described above.

Second Embodiment

<Configuration of Image Forming Apparatus>

Figure 2:
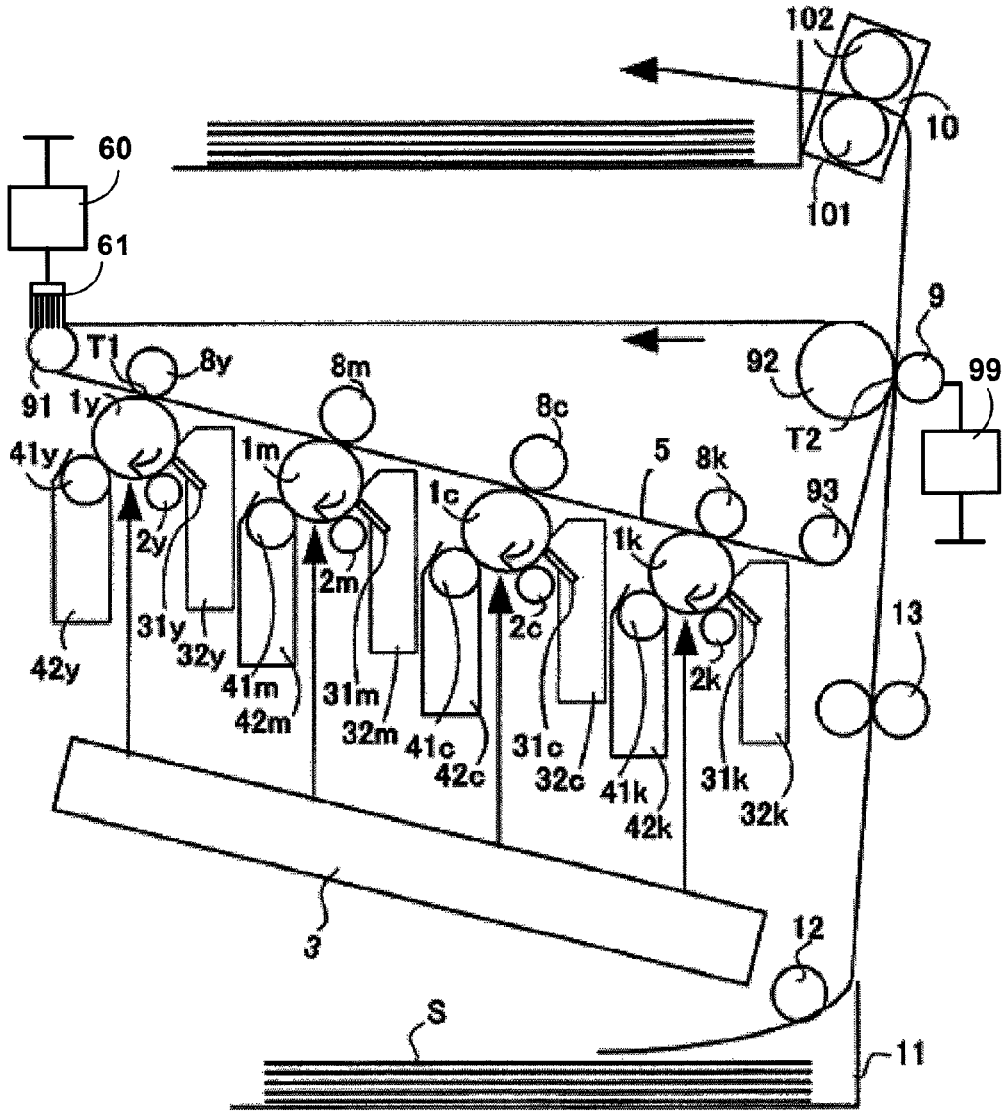
FIG. 2 is a sectional view showing an overall configuration of an image forming apparatus according to a second embodiment.

FIG. 2 is a sectional view showing an overall configuration of an image forming apparatus according to a second embodiment.

According to the present embodiment, a cleaning brush 61 is placed, as a toner charging member, instead of the cleaning roller 6 according to the first embodiment. The rest of the configuration is the same as the first embodiment, and thus description thereof will be omitted. The cleaning brush 61 is made of electrically conductive nylon fiber measuring $1\times10^6$ to $1\times10^9$ Ωcm and is 3 mm wide. A tip position of the cleaning brush 61 is fixed with an infeed of 1.0 mm with respect to a surface of the intermediate transfer belt 5. According to the present embodiment, the cleaning brush 61 is connected to ground of the apparatus body, but this is not restrictive. A bias with a polarity opposite to the charge polarity of the toner is applied to the cleaning brush 61 from the high-voltage power supply 60 to charge the remaining toner.

An advantage of the cleaning brush 61 is the capability to disperse the remaining toner over the intermediate transfer belt 5.

If there is a large amount of remaining toner due to reduced secondary transfer efficiency, two or more layers of remaining toner could be formed on the intermediate transfer belt 5. In such a case, the remaining toner in an upper layer does not contact the intermediate transfer belt 5. Consequently, charge decay of toner is reduced, which could result in insufficient charging. According to the present embodiment, since the cleaning brush 61 is provided, even if there is a large amount of remaining toner on the intermediate transfer belt 5, the cleaning brush 61 can smooth the remaining toner into substantially a single layer on the intermediate transfer belt 5. This increases the amount of remaining toner placed in contact with the intermediate transfer belt 5, facilitating the charge decay of the remaining toner after the secondary transfer. Also, the remaining toner on the intermediate transfer belt 5 is substantially single-layer, the cleaning brush 61 can impart sufficient charge to the remaining toner.

Third Embodiment

A third embodiment differs from the first embodiment in that four rollers are used to stretch the intermediate transfer belt 5. According to the present embodiment, the cleaning roller 6 is placed and facing a roller internal contacting with the intermediate transfer belt 5 just in front of the primary transfer portion T1 for yellow. The image forming apparatus has a configuration similar to the first embodiment except for the number of rollers used to stretch the intermediate transfer belt 5, and thus description of the same components as those in the first embodiment will be omitted.

<Configuration of Image Forming Apparatus>

Figure 3:
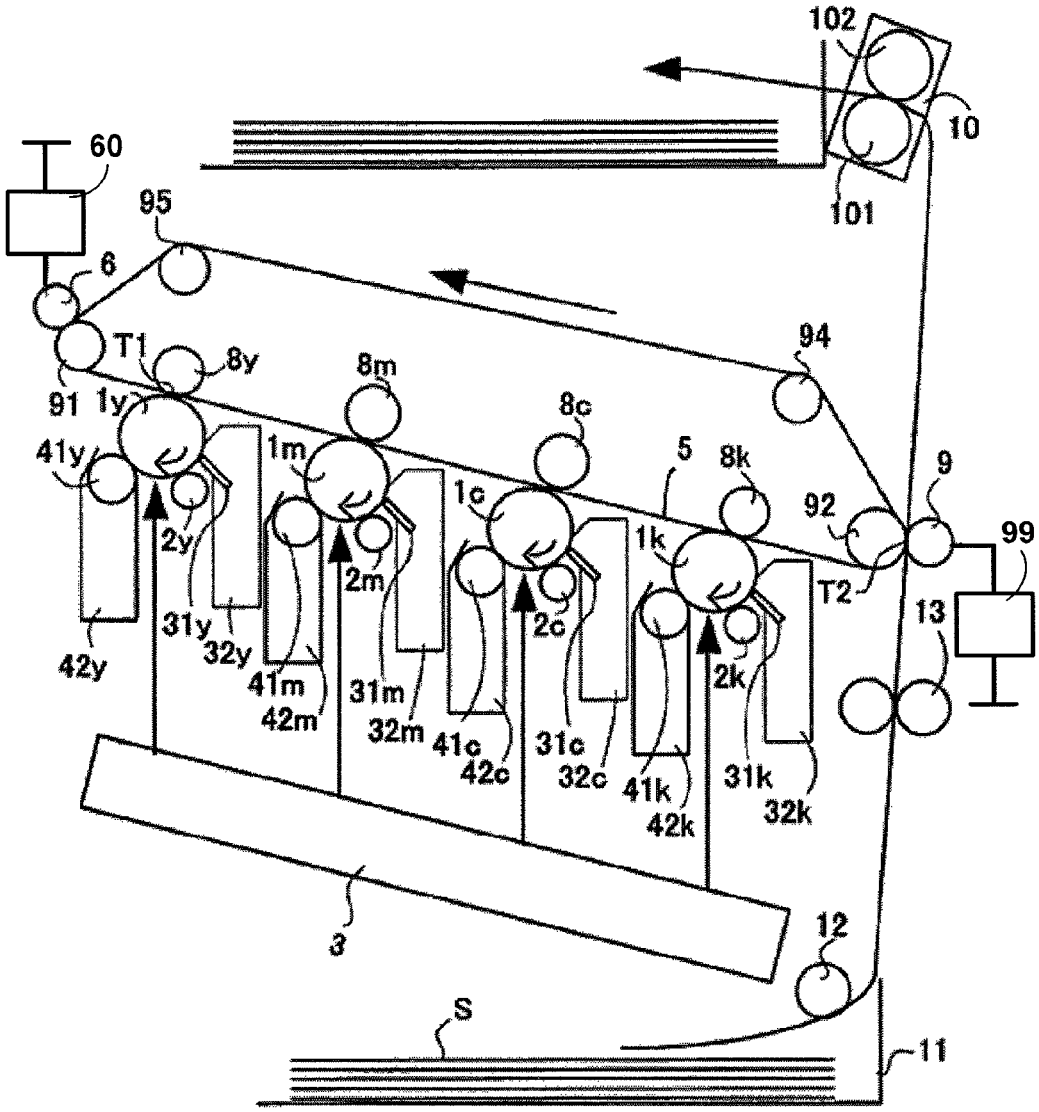
FIG. 3 is a sectional view showing an overall configuration of an image forming apparatus according to a third embodiment.

FIG. 3 is a longitudinal sectional view showing an overall configuration of an image forming apparatus according to the third embodiment.

According to the present embodiment, the intermediate transfer belt 5 is stretched by the secondary transfer counter roller 92 and driven rollers 91, 94 and 95. The driven rollers 91, 94 and 95 apply appropriate tension to the intermediate transfer belt 5. The secondary transfer counter roller 92 is located most upstream among the rollers (rollers stretching the intermediate transfer belt 5) located downstream of the photosensitive drum 1*k*. The cleaning roller 6 is disposed so as to face the driven roller 91 disposed most downstream among the rollers stretching the intermediate transfer belt 5 when viewed from the secondary transfer portion T2. The driven rollers 91, 94 and 95 are grounded to the apparatus body.

As described in the first embodiment, locations where the residual toner is prone to scatter are locations where the intermediate transfer belt bends. According to the third embodiment, the intermediate transfer belt is bent greatly by the driven roller 91. Thus, charging the remaining toner just in front of the bend using a toner charging member can be an effective measure against scattering.

From the viewpoint of cleaning performance, it is advisable to charge the remaining toner to the polarity opposite to the original polarity using the cleaning roller 6 after the charge of the remaining toner has decayed as much as possible. The charge of the remaining toner is transmitted from the top surface to the bottom surface of the intermediate transfer belt 5 and grounded to the apparatus body via the driven rollers 91, 94 and 95. Therefore, to facilitate the charge decay of the remaining toner, a part of the intermediate transfer belt 5 which carries the remaining toner is configured to pass as much as possible through the driven rollers stretching the intermediate transfer belt 5, as with the present embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-194062, filed Aug. 31, 2010, which is hereby incorporated by reference herein in its entirety.

What is claimed is:

1. An image forming apparatus comprising:

a plurality of image bearing members adapted to carry toner images;

an endless and rotatable intermediate transfer belt secondary transferring the toner images, which are primary transferred from the image bearing members to the intermediate transfer belt;

a plurality of stretching members around which the intermediate transfer belt is stretched;

a secondary transfer member secondary transferring the toner images from the intermediate transfer belt to a transfer material; and a toner charging member charging residual toner remaining on the intermediate transfer belt without being transferred to the transfer material, wherein the residual toner charged by the toner charging member is moved from the intermediate transfer belt to the image bearing members, wherein the toner charging member contacts the intermediate transfer belt at a position where the toner charging member opposes one of the stretching members, which is placed farther away from the secondary transfer member than the other stretching members, with the intermediate transfer belt being disposed therebetween, and wherein the toner charging member contacts the intermediate transfer belt at a position upstream of at least an area where the intermediate transfer belt is bent by the one stretching member.

2. The image forming apparatus according to claim 1, wherein the toner charging member is a charging brush, and a tip of the charging brush contacts the upper stretched portion of the intermediate transfer belt.

3. The image forming apparatus according to claim 1, wherein the image bearing members are arranged below the intermediate transfer belt and contact a lower stretched portion of the intermediate transfer belt.

4. The image forming apparatus according to claim 1, wherein the toner image is primary transferred from the image bearing members to the intermediate transfer belt at the same time when the residual toner charged by the toner charging member is moved from the intermediate transfer belt to the image bearing members.

5. The image forming apparatus according to claim 1, wherein the toner charging member is placed with respect to the intermediate transfer belt in a rotation direction of the intermediate transfer belt such that a first distance of the intermediate transfer belt from a position where the secondary transfer member contacts the intermediate transfer belt to a position where the toner charging member contacts the intermediate transfer belt is longer than a second distance of the intermediate transfer belt from the position where the toner charging member contacts the intermediate transfer belt to a position where an image bearing member placed most upstream in the rotation direction of the intermediate transfer belt contacts the intermediate transfer belt.

6. The image forming apparatus according to claim 5, wherein the toner charging member contacts an upper stretched portion of the intermediate transfer belt which is formed by the stretching members, and wherein the first distance is longer than a third distance from the position where the image bearing member placed most upstream along the rotation direction of the intermediate transfer belt contacts the intermediate transfer belt to a position where an image bearing member placed most downstream contacts the intermediate transfer belt.

* * * * *